United States Patent [19]

Capper

[11] 4,145,084

[45] Mar. 20, 1979

[54] MINIATURE WICKER FURNITURE AND METHOD OF ASSEMBLING SAME

[76] Inventor: Joan M. Capper, 900 High Green Ct., Marietta, Ga. 30067

[21] Appl. No.: 818,446

[22] Filed: Jul. 25, 1977

[51] Int. Cl.[2] ..... A47C 5/02; A63H 33/00

[52] U.S. Cl. ..... 297/418; 46/15; 297/445; 297/463

[58] Field of Search ..... 46/15; 297/418, 445, 297/463; D6/51, 57

[56] References Cited

U.S. PATENT DOCUMENTS 802,089 10/1905 Scherrer ..... 297/418 X

FOREIGN PATENT DOCUMENTS 528822 11/1940 United Kingdom ..... 297/463

*Primary Examiner*—James C. Mitchell
*Attorney, Agent, or Firm*—Robert B. Kennedy

[57] ABSTRACT

Miniature furniture having imitation reedy wickerwork comprised of a sheet of wallpaper having a layer of woven straw bonded to a backing sheet of paper and a support upon which the backing sheet is mounted.

A method of assembling a miniature wicker armchair is also disclosed wherein legs are mounted to a seat base, and arm supports mounted to the top of the legs thereby forming an armchair frame. A jig is provided having an upper set of pins projecting from the jig top and a lower set of pins projecting from the jig sides with pins in the lower set alternatively offset laterally from pins in the upper set. The armchair frame is placed in an inverted position upon the jig with the seat base positioned adjacent the upper set of pins and the arm supports positioned adjacent the lower set of pins. Thread is then wound about the pins over the seat base and arm supports to form a threaded mesh spanning the seat base and arm supports. Thread overlaying the seat base and arm supports is glued to the seat base and arm supports and the armchair frame and threaded mesh removed from the jig.

10 Claims, 7 Drawing Figures

MINIATURE WICKER FURNITURE AND METHOD OF ASSEMBLING SAME

BACKGROUND OF THE INVENTION

This invention relates generally to miniature furniture, and specifically to miniature furniture of the type bearing the appearance of wicker furniture and to methods of making such.

Minature furniture is quite popular today both for adult collection as well as for its traditional use as play things for children. For adult appeal miniature furniture should be crafted to resemble full scale furniture with a high degree of accuracy. With some types of miniature furniture, such as rattan chairs and tables, this is not too difficult to achieve through the use of assemblies of varnished rods and stems. Similarly, wrought iron furniture may be accurately imitated on a small scale through the use of assemblies of metallic strands.

There has, however, remained one form of miniature furniture that has proven extremely difficult to duplicate in appearance, namely that of wicker furniture. Full scale wicker furniture is ordinarily composed of a mesh of woven reeds or straw that is mounted to a frame such as to a chair seat base and legs. These reeds however are generally unavailable in nature on a greatly reduced size scale such as that which would be utilized in the fabrication of miniature wicker furniture. Furthermore, to imitate such through the use of woven paper strands or threads on a miniaturized scale would be extremely difficult to accomplish in actual practice with any degree of manufacturing efficiency. Although this may be done with manual craftsmanship through tedious and diligent work, the time and effort involved in making a single item of miniature wicker furniture far exceeds that which can be cost justified to most potential purchasers.

Accordingly, it is a general object of the present invention to provide an article of miniature furniture.

Another general object of the invention is to provide a method of assembling miniature wicker furniture.

More specifically, it is an object of the invention to provide miniature furniture of relatively simple and economic construction that closely resembles full scale wicker furniture.

Another object of the invention is to provide a method of assemblying a miniature wicker armchair in an efficient, speedy and economic manner.

SUMMARY OF THE INVENTION

In one form of the invention an article of miniature furniture is provided which has imitation reedy wickerwork comprised of a sheet of wallpaper having a layer of woven straw bonded to a backing sheet of paper, and a support upon which the backing sheet is mounted.

In another form of the invention a miniature wicker chair is provided comprising a seat base to which a set of upright legs are mounted, and a pair of arms mounted atop the legs. Each leg has a rod wrapped with thread while each arm has a support strip with the strip top overlaid with woven straw wallpaper and the strip sides overlaid with braid.

In yet another form of the invention a method of assemblying a miniature wicker arm chair is provided which comprises the steps of mounting legs to a seat base and arm supports to the top of the legs thereby forming an armchair frame. A jig is provided having an upper set of pins projecting from the jig top and a lower set of pins projecting from the jig sides with pins in the lower set alternatively offset laterally from pins in the upper set. The armchair is placed in an inverted position upon the jig with the seat base positioned adjacent the upper set of pins and the arm supports positioned adjacent the lower set of pins. Thread is wound about the pins over the seat base and arm supports to form a thread mesh spanning the seat base and the arm supports. Threads overlaying the seat base and arm support are glued to the seat base and arm supports, and the armchair frame and threaded mesh removed from the jig and its pins.

DESCRIPTION OF THE PREFERRED EMBODIMENTS

Figure 1:
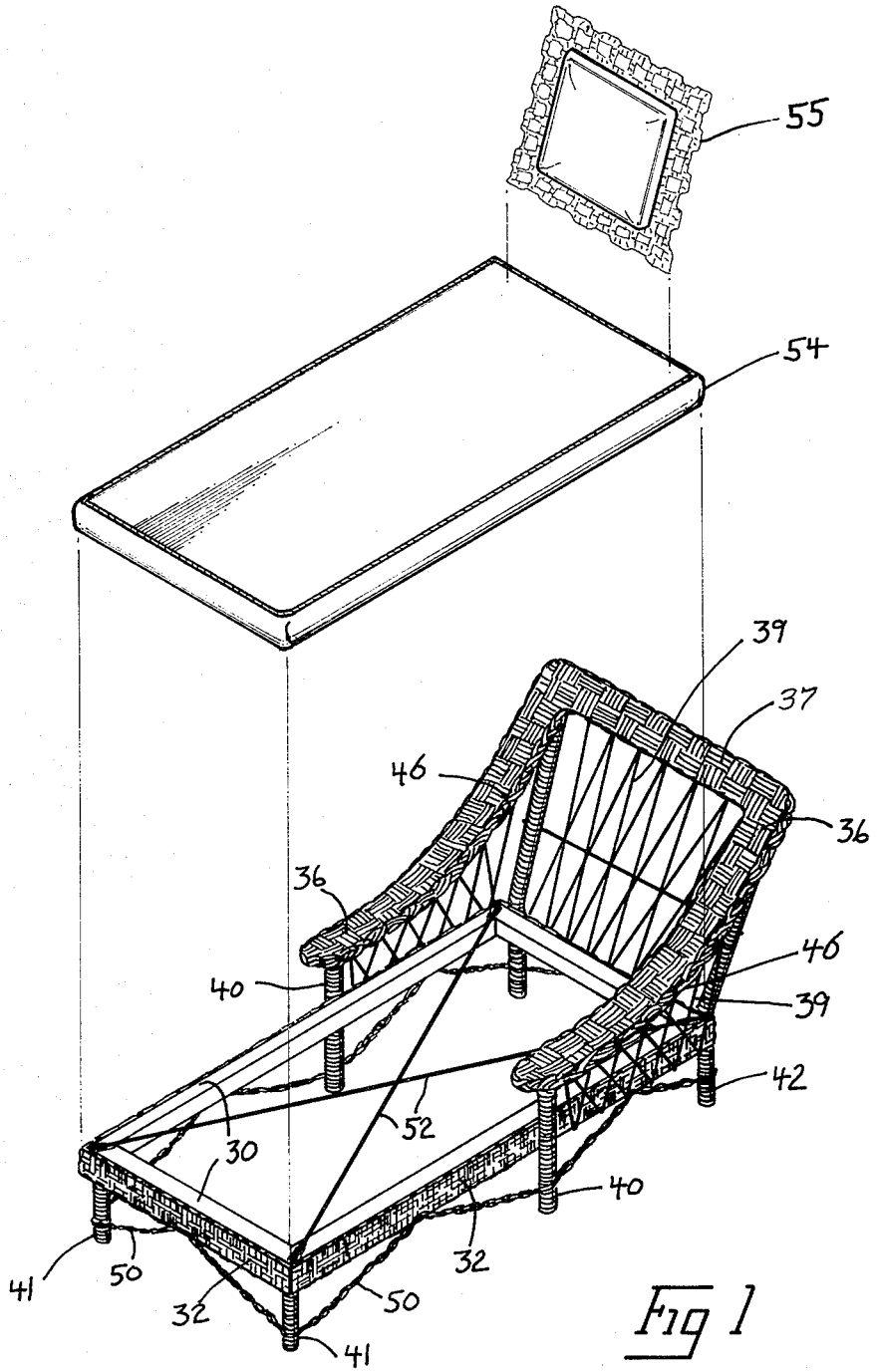
FIG. 1 is a perspective view of a miniature wicker armchair embodied principles of the present invention.
Figure 2:
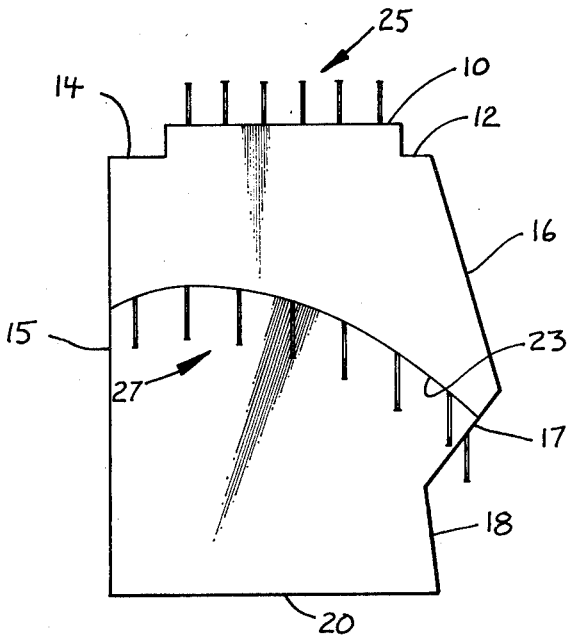
FIG. 2 is a side elevational view of a jig utilized in assembling the miniature wicker armchair of FIG. 1.
Figure 3:
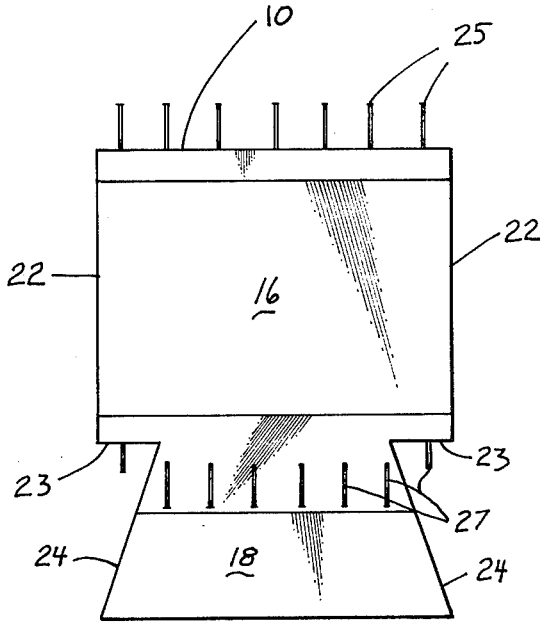
FIG. 3 is a front elevational view of the jig shown in FIG. 2.

Referring now in more detail to the drawing, there is shown in FIG. 2 and 3 a jig constructed for use in assemblying a miniature wicker armchair of the type shown in FIG. 1. The article of furniture shown here is ordinarily referred to as a chair lounge but herein is termed armchair within the meaning of a chair with arms. The jig, which may be of soft wood construction, is seen to include a flat top 10 straddled by two steps 12 and 14, a back 15, and a front consisting of an upper portion 16, an intermediate portion 17, and a lower portion 18. The jig also has a flat bottom 20, two sides each comprised of an upper vertical wall 22, a horizontal overhand 23, and an inclined lower wall 24. An upper set of pins 25 project in u-formation upwardly from the top surface 10 while a lower set of pins 27 project in u-shaped formation downwardly from portion 17 and overhang 23.

Figure 4:
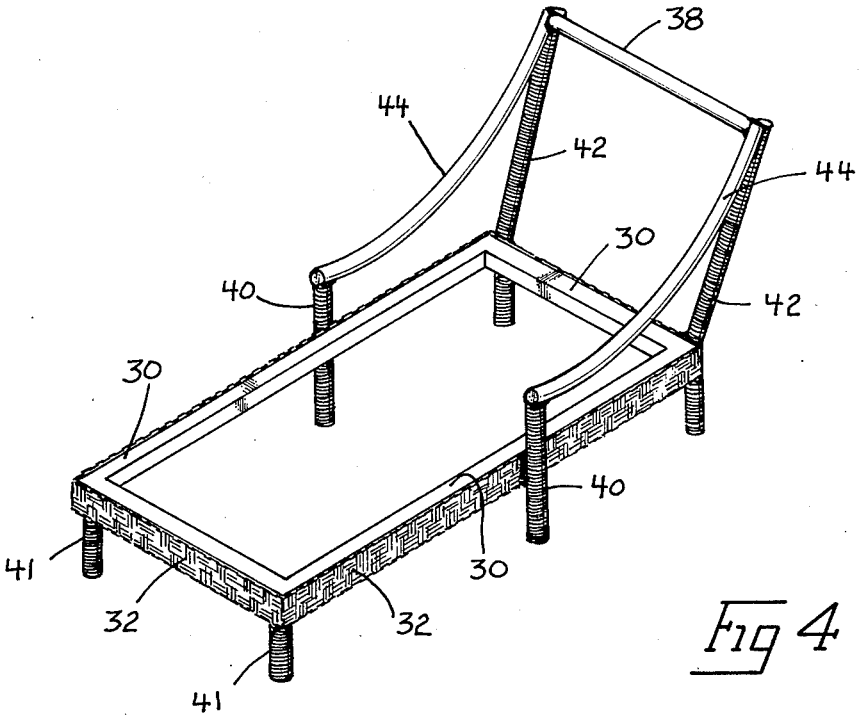
FIG. 4 is a perspective view of a partially completed miniature wicker armchair of the construction shown in FIG. 1.

Prior to utilization of the just described jig the miniature wicker armchair is assembled to the frame shown in FIG. 4. Firstly, the rectangular seat base is formed by four straight strips 30 of wood such as balsa. A strip of wallpaper 32, comprised of a paper backing sheet 33 to which a lattice work of woven straw 34 is bonded, is then glued to the outside surface of the balsa wood strip. This same procedure is followed in forming the two arms 36 and the headboard 37 except in these latter cases a braided trim 46 is glued to the sides of strip 30 overlaying and extending somewhat beyond the edges of the wallpaper 32. At this stage of construction the armchair frame also has six legs the front two of which 41 are glued to the bottom corners of the seat base while the other four are glued to the exterior side of the base. Each leg is formed by a pin dowel pin wrapped and glued with crochet thread. The tops of the two rearward most legs 42 are spanned with a straight willow reed 38 while the tops of the intermediate legs 40 are spanned to the tops of the rear legs 42 by bowed willow reeds 44.

Figure 5:
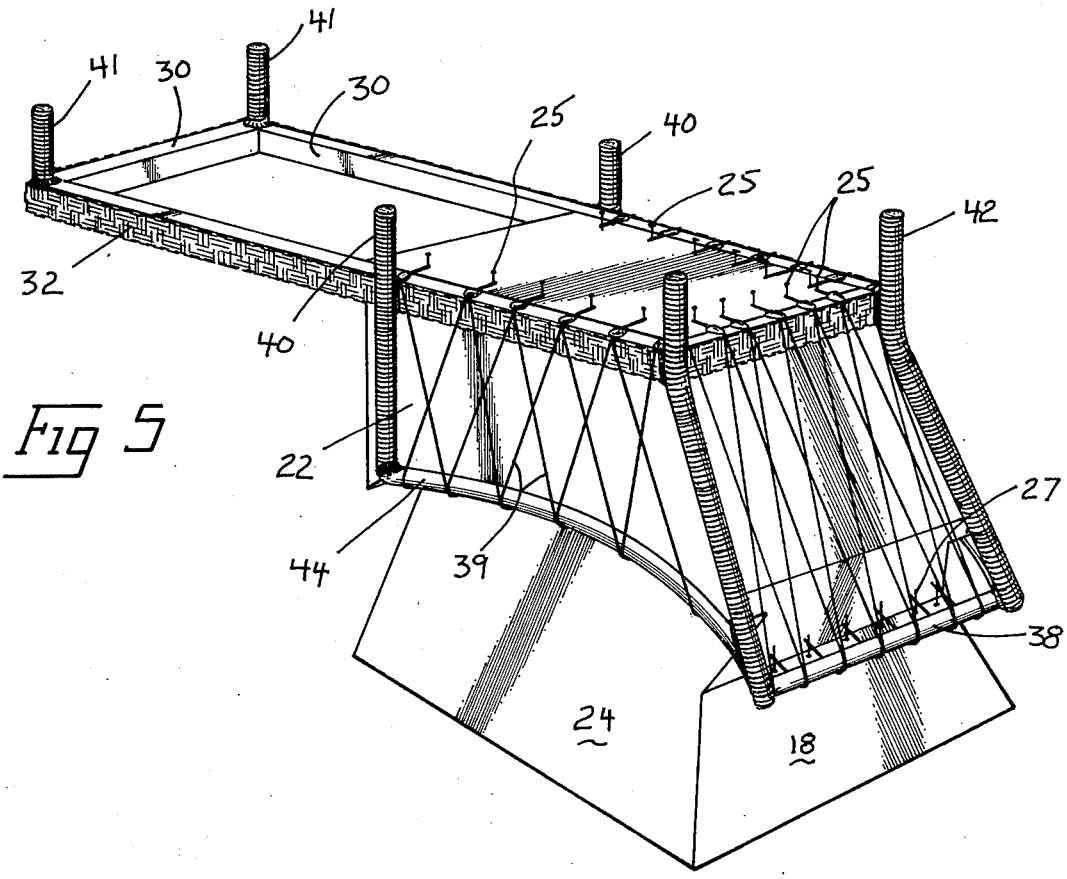
FIG. 5 is a perspective view of the partially completed armchair of FIG. 4 shown mounted atop the jig illustrated in FIGS. 2 and 3.

With the armchair frame now constructed it is inverted and placed atop the jig in the position illustrated in FIG. 5. In this position the seat base is seen to be located closely adjacent the upper set of pins 25 while the arms supports 44 and head rest support in the form of willow reed 38 are located aside the lower set of pins 27. Next crochet thread 39 is tied to an end member of the upper set of pins 25 and then wound down over the outer surface of the wall paper 32 covering the seat base, down over arm supports 44, over the pins in the lower set of pins 27, and then back around and up to the next pin in the upper set and so forth all the way around the back of the chair and the other side to the last pin. The procedure is then reversed back around the two sides and back of the chair thereby forming a lattice network of thread. Drops of glue 45 are then placed upon the bottom of the base strips 30 where the thread is overlaid and allowed to set. The threads are then cut at points adjacent the glue thereby removing the excess thread from the base while simultaneously releasing the chair from the jig. The armchair is then removed from the jig and set aside.

Figure 6:
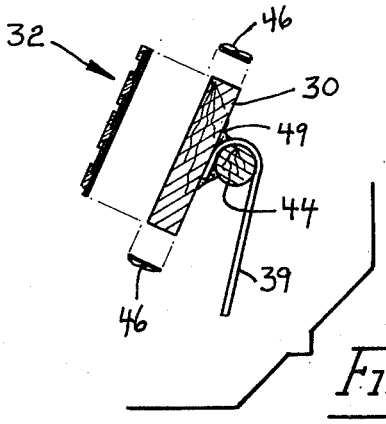
FIG. 6 is an exploded view, in cross-section, of the seat base of the armchair shown in FIG. 5.
Figure 7:
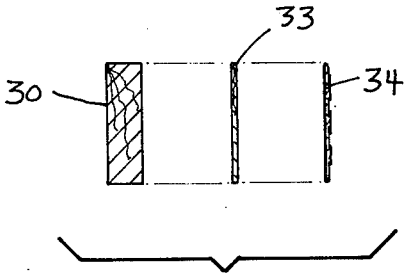
FIG. 7 is another exploded, cross-sectional view of a portion of the base component shown in FIG. 6.

Next the two flat arm supports and the headboard are formed as previously described with balsa strips overlaid with wallpaper of the type described, and trimmed with braid 46. Then, as shown in FIG. 6, a ribbon of adhesive or glue 49 is coated along the tops of the arm supports 44 and the head rest support. The wallpaper coated and braided strips are then placed thereatop with the thread 39 sandwiched therebetween. If desired, the braid may be overlaid a sufficient distance to hide this construction when viewed from the top thereof. Finally, decorative braiding 50 is draped along the seat base, a cross strip of thread 52 secured from opposing corners thereof, and the entire frame sprayed with white paint. A pad 54 and pillow 55 may then be nestled upon the frame thereby completing the armchair.

It is thus seen that an article of miniature wicker furniture is provided and a method for assembling same. The method allows an article of miniature furniture to be assembled with relatively ease, accuracy, and in a minimum amount of time. The resulting product is found by most people to be quite attractive and to resemble actual wicker furniture to a remarkable degree.

It should however be understood that the just described embodiments may illustrate principles of the invention in selected forms. Many modifications, additions, and deletions may, of course, be made thereto without departure from the spirit and scope of the invention as set forth in the following claims.

I claim:

1. An article of miniature furniture having a frame comprised of assembled seat base, back and leg members with at least one frame member including a support covered with imitation reedy wickerwork comprised of a sheet of wallpaper having a layer of wooven straw bonded to a backing sheet of paper.

2. An article of miniature furniture in accordance with claim 1 wherein said woven straw is coated with white paint.

3. An article of miniature furniture in accordance with claim 1 wherein said support is composed of wood.

4. An article of miniature furniture in accordance with claim 3 wherein said backing sheet is glued directly to said wood frame.

5. An article of miniature furniture in accordance with claim 1 further comprising a braided trim mounted to at least one side of said support overlaying an edge of said sheet of wallpaper.

6. An article of miniature furniture in accordance with claim 5 wherein said braided trim is mounted to each side of said support, and wherein said support is mounted atop a reed with a plurality of thread ends of a threaded mesh sandwiched between said reed and said support.

7. A miniature wicker chair comprising a horizontal seat base to which a set of upright legs is mounted and a pair of arms mounted atop said legs, and wherein each of said legs comprises a rod wrapped with thread and each of said arms comprises a support strip having its top surface overlaid with woven straw wallpaper and its side surfaces overlaid with braid.

8. A miniature wicker chair in accordance with claim 7 having a network of threads spanning said seat frame and arms.

9. A miniature wicker chair in accordance with claim 8 coated with paint.

10. A miniature wicker chair in accordance with claim 7 wherein a side of said seat base is overlaid with woven straw wallpaper.

* * * * *